US006189160B1

(12) United States Patent
Pettus

(10) Patent No.: US 6,189,160 B1
(45) Date of Patent: Feb. 20, 2001

(54) TOILET SEAT-LIFTING DEVICE

(75) Inventor: Godfrey L. Pettus, Cleveland Heights, OH (US)

(73) Assignee: Margo Small Business Developement & Consulting Ltd., Cleveland Heights, OH (US)

( * ) Notice: Under 35 U.S.C. 154(b), the term of this patent shall be extended for 0 days.

(21) Appl. No.: 09/231,468

(22) Filed: Jan. 14, 1999

Related U.S. Application Data

(60) Provisional application No. 60/071,816, filed on Jan. 20, 1998, provisional application No. 60/074,981, filed on Feb. 17, 1998, provisional application No. 60/090,250, filed on Jun. 22, 1998, and provisional application No. 60/096,741, filed on Aug. 17, 1998.

(51) Int. Cl.[7] ..... A61C 17/06
(52) U.S. Cl. ..... 4/264.1; 4/246.3
(58) Field of Search ..... 4/246.1, 246.3, 4/246.4, 246.5, 246.2; D23/303, 304, 305, 306, 307, 308, 309, 310, 311

(56) References Cited

U.S. PATENT DOCUMENTS

| | | | | |
|---|---|---|---|---|
| D. 389,231 | * | 1/1998 | Yarbrough et al. | D23/303 |
| 621,790 | | 3/1899 | Burger et al. . | |
| 1,999,070 | | 4/1935 | Svedelius . | |
| 3,516,095 | | 6/1970 | Clifton et al. . | |
| 4,470,161 | | 9/1984 | Seabrooke . | |
| 4,584,724 | | 4/1986 | Wilson . | |
| 5,075,906 | | 12/1991 | Robbins . | |
| 5,237,708 | | 8/1993 | Zamoyski . | |
| 5,327,589 | | 7/1994 | Rice . | |
| 5,404,595 | | 4/1995 | Carmel . | |
| 5,444,877 | | 8/1995 | Kumarasurier . | |
| 5,487,192 | | 1/1996 | Hodges . | |
| 5,594,958 | * | 1/1997 | Nguyen | 4/246.5 |
| 5,713,084 | | 2/1998 | Greco . | |
| 5,857,223 | * | 1/1999 | Ferdinand | 4/246.1 |
| 5,875,498 | * | 3/1999 | Joseph | 4/246.5 |

* cited by examiner

*Primary Examiner*—Steven O. Douglas
*Assistant Examiner*—Huyen Le
(74) *Attorney, Agent, or Firm*—Renner, Otto, Boisselle & Sklar, LLP

(57) ABSTRACT

A toilet seat-lifting device including a lever assembly coupled to the toilet seat which selectively moves the seat between a lower position whereat it rests on top edges of the toilet bowl to an upper position whereat it is raised above the top edges of the toilet bowl. The lever assembly is mounted on a platform that rests on the floor and a pedal attached to the lever assembly in such a manner that as the pedal is pushed downward, the toilet seat is lifted to the upper position. The platform provides a stable support for the lever assembly without having to directly attach the device to the toilet's base or floor. Also, the seat-lifting device is adapted to allow mounting of the stand on either the right-hand or left-hand side of the toilet. Further, the lever assembly includes an adjustable connection between a lift arm and a pedal-connecting arm to accommodate different height toilet bases and/or different desired upper positions. Additionally or alternatively, a seat-interface may be provided for attachment of the lever assembly to the toilet seat.

14 Claims, 6 Drawing Sheets

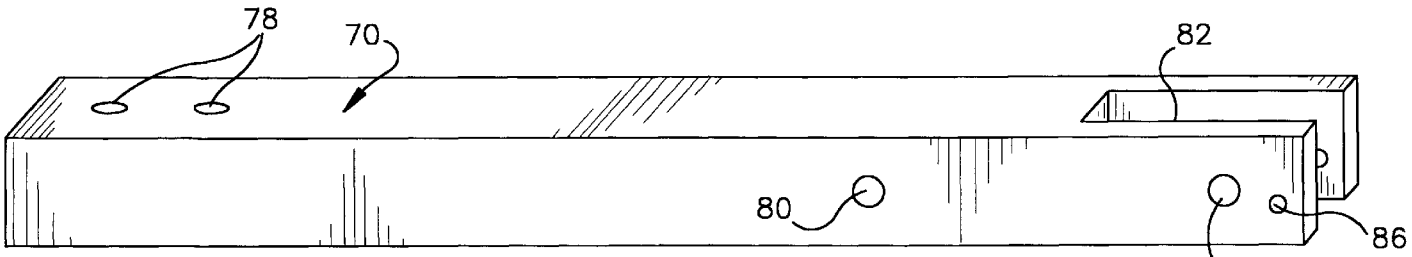
Fig.10
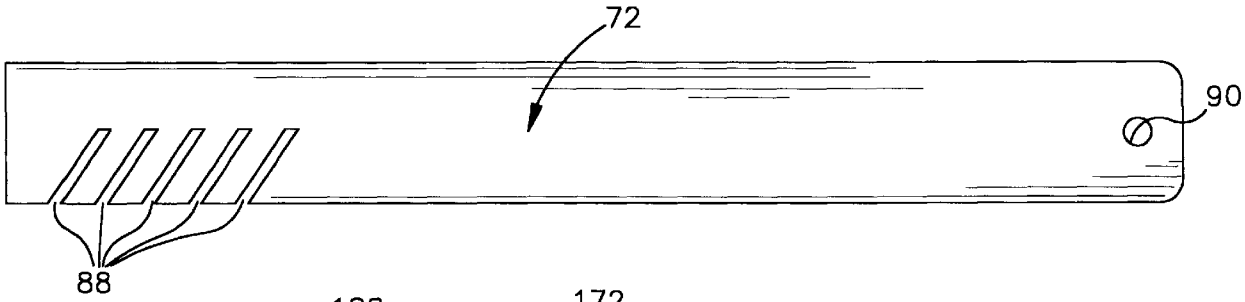
Fig.11
Fig.12
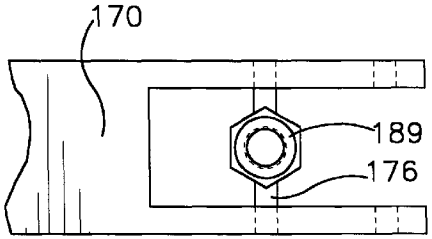
Fig.13

TOILET SEAT-LIFTING DEVICE

RELATED APPLICATIONS

This application is a conversion under 35 U.S.C. §119(e) of U.S. Provisional Patent Application Ser. No. 60/071816 filed Jan. 20, 1998; U.S. Provisional Patent Application Ser. No. 60/074981 filed Feb. 17,1998; U.S. Provisional Patent Application Ser. No. 60/090250 filed Jun. 22,1998; and U.S. Provisional Patent Application No. 60/096741 filed Aug. 17,1998. The entire disclosures of each of these provisional applications is hereby incorporated by reference.

FIELD OF THE INVENTION

The present invention relates to a lifting device which selectively moves a toilet seat from a lower position whereat it rests on top edges of the toilet bowl to an upper position whereat it is raised above the top edges of the toilet bowl.

BACKGROUND OF THE INVENTION

A typical toilet comprises a tank and a base hydraulically coupled together so that the plumbing functions of the toilet may be performed. The upper portions of the base define a toilet bowl and the lower portions of the base rest on, and are usually secured to, the floor of a bathroom. A toilet usually additionally includes a seat pivotally attached, such as by a pair of hinge members, to a portion of the base defining the back edge of the bowl. A lid for the seat may also be provided and may also be pivotally attached by the hinge members to the base and/or the seat.

A toilet seat is typically raised from a lower position to a fully raised position by grasping the front edge of the seat and manually moving it upwards. In the lower position, the toilet seat rests on the upper edges of the toilet bowl whereby it lies in a substantially horizontal plane. In the fully raised position, the toilet seat rests on the front wall of the tank whereby it lies in a "more than vertical" plane. That is, the toilet seat is pivoted from a horizontal position, to a vertical position, and just beyond the vertical position to prevent inadvertent lowering of the seat due to gravity. In other words, when moving from the lower position to the fully raised position, the seat is pivoted in an angle that is more than 90°.

In the past, various devices have been proposed for lifting the toilet seat so that a person does not have to grasp the front edge of the seat and/or manually lift the seat. Such toilet seat-lifting devices are disclosed in U.S. Pat. Nos. 621,790; 3,516,095; 4,470,161; 4,584,724; 5,075,906; 5,237,708; 5,327,589; 5,404,595; 5,444,877; 5,487,192; and/or 5,713,084.

Many of the prior art seat-lifting devices may have functioned acceptably. However, especially in view of the recent sophistication of bathrooms, they are not without certain drawbacks and disadvantages. Bathrooms have evolved over the years from purely functional facilities to deliberately decorated areas displayed with pride during home tours.

By way of an example, many bathrooms now have ceramic tiles, carpet or other expensive types of flooring. Also, bathroom fixtures, including the toilet, are often chosen to coordinate with each other and/or for their artistic contribution to the overall aura of the room. Many of the prior art toilet seat-lifting devices, especially those employing foot pedals as their actuating means, require that the device be secured to the bathroom floor or the toilet. Accordingly, bolts, glue or other intrusive attachment means must be used that may deface or permanently scar bathroom floors and toilet fixtures.

By way of another example, bathrooms are now provided in many different layout designs. In some instances, the bathroom design may accommodate the installation of a toilet seat-lifting device on either side of the toilet. However, in many instances, the device may only fit on the left-hand side of the toilet or, alternatively, on the right-hand side of the toilet. Moreover, if the toilet seat-lifting device is to be used by a physically challenged person, his/her abilities may require a particular (i.e., left-hand or right-hand) installation. Many of the prior art toilet seat-lifting devices are only adapted for installation on one side of the toilet. Accordingly, separately designed devices must be provided depending on whether the device is to be installed on the lefthand or right-hand side of the toilet.

By way of yet another example, a result of the evolving sophistication of bathrooms has been the many different toilet designs now available and being used. The large selection of toilets now available vary in size, such as the height of the toilet base or, in other words, the vertical distance from the floor to the toilet seat. Also, the attachment of the seat to the toilet's base will vary between designs. Additionally or alternatively, the desired location of the upper position of the toilet seat may vary depending on the circumstances. Many of the prior art devices cannot be easily adjusted to accommodate different sized toilets, different seat attachment arrangements, and/or different seat-positioning.

Accordingly, a need still remains for an improved toilet seat-lifting device that does not require defacement of bathroom floor/fixtures, that can be installed on either side of the toilet, and/or that accommodates different toilet designs.

SUMMARY OF THE INVENTION

The present invention provides an improved toilet seat-lifting device that does not require marring or scarring of existing bathroom floors or fixtures. More particularly, the present invention provides a toilet seat-lifting device wherein a lever assembly selectively moves the seat from a lower position whereat it rests on top edges of the toilet bowl and an upper position whereat it is raised above the top edges of the toilet bowl. The lever assembly is mounted on a platform that rests on the floor. The platform at least partially surrounds the bottom edges of the toilet's base to provide a stable support for the lever assembly without having to directly attach the device to the toilet's base or floor. Accordingly, the seat-lifting device may be installed without having to use bolts, glue or other attachment means to secure the device to the bathroom floor and/or the toilet base.

Additionally or alternatively, the present invention provides an improved toilet-lifting device that accommodates different bathroom layouts. More particularly, the device comprises a lever assembly coupled to the toilet seat, a stand on which the lever assembly is pivotally supported, a platform on which the stand is mounted on either a right-hand or left-hand side of the toilet, and a pedal coupled to the lever assembly so that when the pedal is pushed the toilet seat is moved from a lower position whereat it rests on top edges of a toilet bowl to an upper position whereat it is raised above the top edges of the toilet bowl. The seat-lifting device is adapted to allow mounting of the stand on either the right-hand or left-hand side of the toilet.

Still further, the present invention provides an improved toilet seat-lifting device that accommodates different toilet designs. More particularly, the present invention provides a toilet seat-lifting device comprising a lever assembly coupled to a toilet seat and a pedal coupled to the lever assembly. When the pedal is pushed, the toilet seat is moved from a lower position whereat it rests on top edges of a toilet bowl to an upper position whereat it is raised above the top edges of the toilet bowl. The lever assembly comprises a lift arm operably attached to the toilet seat, a pedal arm attached to the pedal, and an adjustable connection between the lift arm and pedal-connecting arm. The toilet seat-lifting device may additionally or alternatively include a seat-interface member attached to a toilet seat to accommodate toilets of different seat attachment means.

These and other features of the invention are fully described and particularly pointed out in the claims. The following description and drawings set forth in detail a certain illustrative embodiment of the invention, this being indicative, however, of but one of the various ways in which the principles of the invention may be employed.

DRAWINGS

FIG. 10 is a perspective view of a pedal-connecting arm of the toilet seat-lifting device.

FIG. 11 is a side view of a lift arm of the toilet seat-lifting device.

FIG. 12 is a side view of a modified version of the lift arm.

FIG. 13 is a partial top view of a modified version of the pedal-connecting arm for use with the lift arm shown in FIG. 10.

DETAILED DESCRIPTION

Figure 1A:
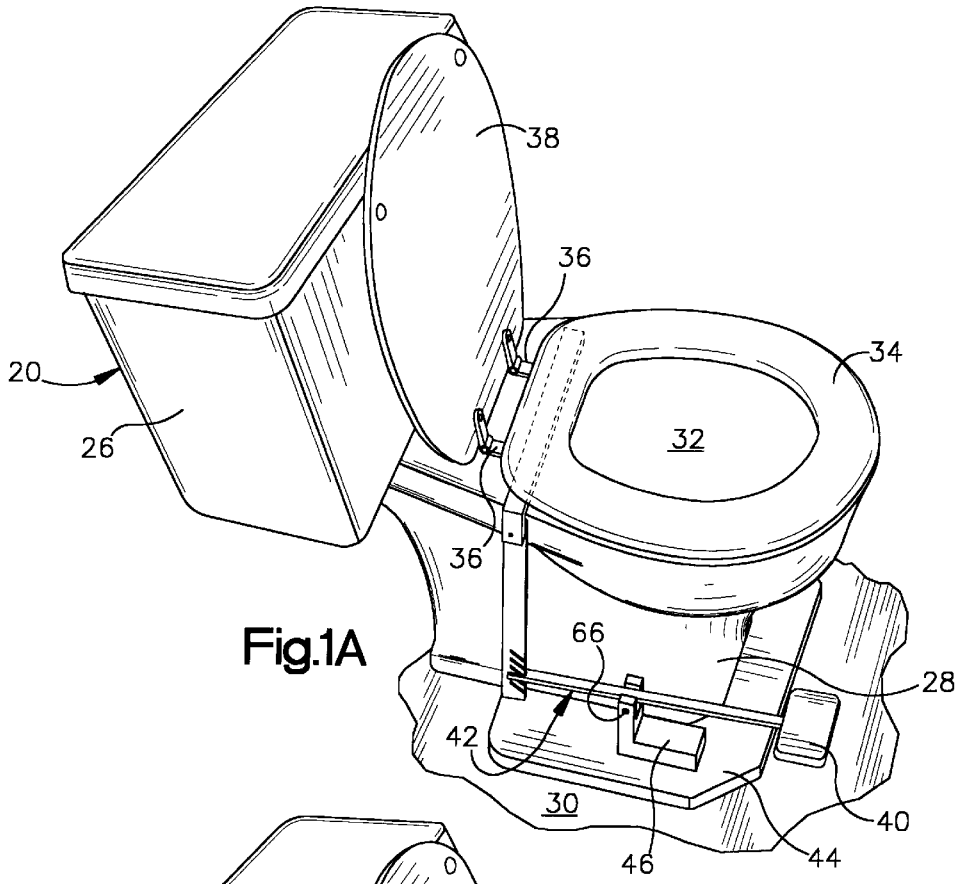
FIG. 1A is a perspective view of a toilet with a seat-lifting device according to the present invention installed thereon, the device being shown in a state corresponding to the toilet seat being in a lower position.
Figure 1B:
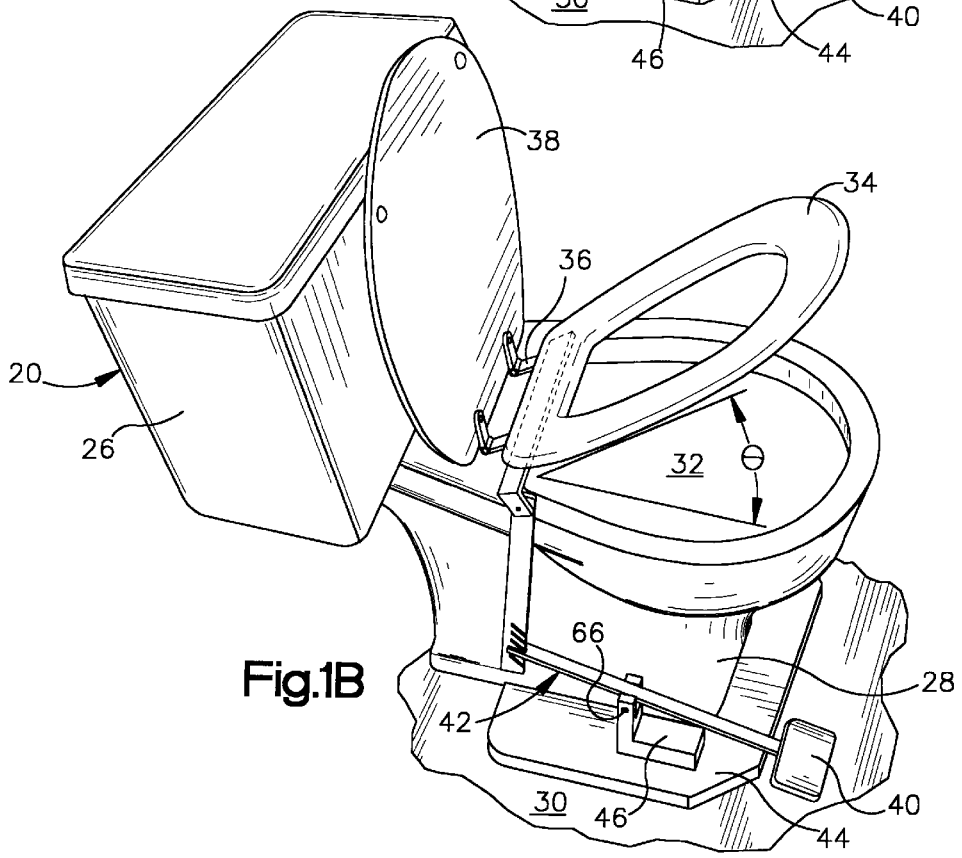
FIG. 1B is a perspective view similar to FIG. 1A except that the toilet seat-lifting device is shown in a state corresponding to the toilet seat being in an upper position.

Referring now to the drawings, and initially to FIGS. 1A and 1B, a toilet 20 and a toilet seat-lifting device 22 according to the present invention is shown. The toilet 20 is of a conventional design and includes a tank 26 and a base 28 hydraulically coupled together so that the plumbing functions of the toilet 20 may be performed. The base 28 rests, and is usually secured, to the floor 30 of a bathroom (or other location). The upper portions of the base 28 define a toilet bowl 32.

The toilet 20 additionally includes a seat 34 pivotally attached by a pair of hinge members 36 to a portion of the base 28 defining the back edge of the bowl 32. Specifically, the front legs of the generally L-shaped hinge members are attached to rear portions of the toilet seat by suitable bolts (not shown). A lid 38 for the seat 34 may also be provided and may also be pivotally attached by the hinge members 36 to the base 28 and/or the seat 34.

Absent the seat-lifting device 22 of the present invention, the toilet seat 34 would be manually raised from a lower position to a fully raised position. In the lower position, the toilet seat 34 rests on the upper edges of the toilet bowl 32 whereby it lies in a substantially horizontal plane. In the fully raised position, the toilet seat 34 rests on the front wall of the tank 26 whereby it lies in a "more than vertical" plane. That is, the toilet seat 34 is pivoted from a horizontal position, to a vertical position, and just beyond the vertical position to prevent inadvertent lowering of the seat 34 due to gravity. In other words, when moving from the lower position to the fully raised position, the seat 34 is pivoted in an angle that is more than 90°.

The seat-lifting device 22 according to the present invention does not require defacement of the bathroom floor/fixtures, it can be installed on either side of the toilet, and/or it accommodates different toilet designs.

The seat-lifting device 22 includes a pedal 40 coupled by a lever assembly 42 to the toilet seat 34. When the seat-lifting device 22 is in a rest position, the seat 34 is in a lower position resting on the top edges of the toilet bowl 32. (See FIG. 1A.) When the pedal 40 is pushed downward by a person's foot, the toilet seat 34 is lifted to an upper position. (See FIG. 1B.) In this manner, the toilet seat 34 may be lifted without requiring the use of a person's hands. Preferably, the upper position of the toilet seat 34 is not in the fully-raised position as discussed above. Instead, when moving from the lower position to the upper position, the seat 34 is pivoted in an angle θ that is 90° degrees or less. More preferably, the toilet seat 34 is pivoted in an angle θ that is between 20° and 80°, and more preferably between 30° and 70°, and even more preferably between 40° and 60°.

In this manner, gravity will return the toilet seat 34 to the lower position upon release of the foot pedal 40. Alternatively, the toilet seat 34 may be gradually returned to the lower position by gently decreasing the pressure on the foot pedal 40. In any event, the toilet seat-lifting device 22 allows the seat 34 to be manually placed in the fully raised position if necessary for cleaning or other purposes.

In addition to the pedal 40 and the lever assembly 42, the seat-lifting device 22 includes a platform 44 and a pivot stand 46. The platform 44 and the pivot stand 46 coordinate to support the lever assembly 42 and the pedal 40. The toilet seat-lifting device 22 is illustrated isolated from the toilet 20 in FIG. 2 and the platform 44 is illustrated isolated from the other components of the device 22 in FIG. 3.

The platform 44 is a flat plate component that, in the embodiment illustrated in FIGS. 1–3, has a roughly rectangular shape (if its cut-out 56, introduced below, is temporarily ignored). Specifically, the platform 44 includes two side sections 48 and a connecting section 50. The outer contour of the platform 44 may be viewed as having two front cut-off corners 52 and two back rounded corners 54. The inner contour of the platform 44 defines a roughly rectangular cut-out 56 shaped to correspond to the contour of the side and front bottom edges of the toilet's base 28. (FIGS. 1A and 1B). In the illustrated embodiment, the base 28 includes rounded front corners whereby the cut-out 56 likewise includes front rounded corners.

The platform 44 rests on the floor 30 adjacent the toilet's base 28 and the front and side edges of the toilet's base 28 are captured in, or surrounded by, the edges of the platform's cut-out 56. (FIGS. 1A and 1B.) Specifically, the side sections 48 are positioned on opposite sides of the toilet's base 28 and the platform's front section 50 is positioned in front of the toilet's base 28. The corresponding contours of the base's front edges and the platform's cut-out 56 results in the platform 44 "hugging" the toilet base 28. This arrangement permits the seat-lifting device 22 to be installed on the toilet 20 without having to use bolts, glue or other attachment means to secure the device 22 to the bathroom floor 30 and/or the toilet base 28. In this manner, the seat-lifting device 22 may be used in a bathroom without permanently scarring ceramic tile, carpet, or other flooring materials and/or without damaging the toilet base 28.

The platform 44 further includes a pair of openings 58 located on each of its side walls 48. One set of these openings 58 is used to attach the pivot stand 46 to the platform 44 with suitable fastening members, such as bolts or screws. Preferably, the openings 58 are counterbored to accommodate the head of such bolts/screws whereby the fastening members may be inserted upwards through the platform 44. By providing a set of openings 58 on each of the side walls 48, the pivot stand 46 (and thus the pedal 40 and the lever assembly 42) may be installed on either the left hand side of the toilet 20 (as shown in FIGS. 1A and 1B) or the right hand side of the toilet 20 depending on the desire/abilities of a person using the seat-lifting device 22 and/or the layout of the bathroom.

Figure 4:
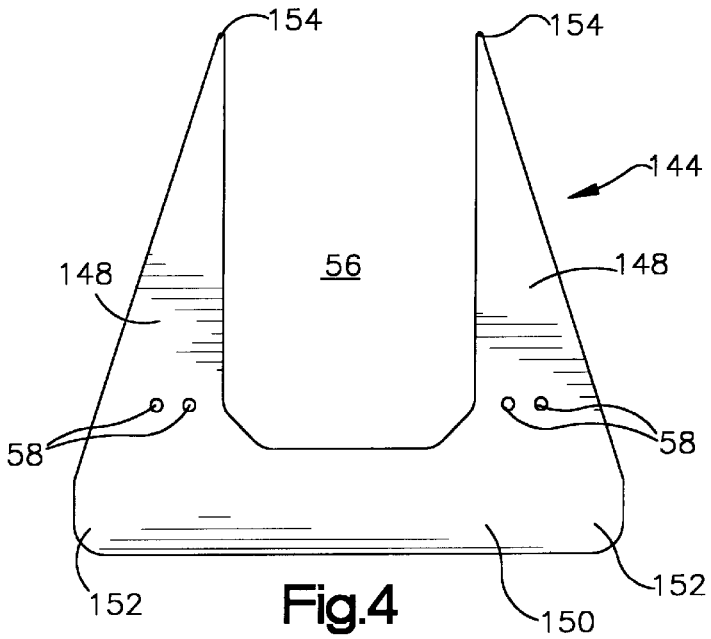
FIG. 4 is a plan view of a modified version of the platform.

A modified version 144 of the platform is shown in FIG. 4. The platform 144 is also a flat plate or mat component, but has a roughly trapezoidal shape. Specifically, the platform 144 has two triangular side sections 148 and a rectangular front section 150 that is somewhat thinner than the front section 50 of the platform 44. The platform's front corners 152 are likewise cut-off (although to a lesser degree than the corners 52) and its two back corners 154 are pointed in view of the triangular shape of the side walls 148. The cut-out 156 is essentially identical to the cut-out 56 and, in any event, is shaped to correspond to the contour of the front edges of the toilet's base 28.

The platform 144 functions in substantially the same manner as the platform 44. Specifically, the platform 144 rests on the floor 30 adjacent the toilet's base 28 and the front and side bottom edges of the toilet's base 28 are captured in, or surrounded by, the edges of the platform's cut-out 156. Also, the platform 144 allows attachment of the pivot stand 46, via openings 158, on either the left-hand or right-hand side of the toilet 20.

Figure 5:
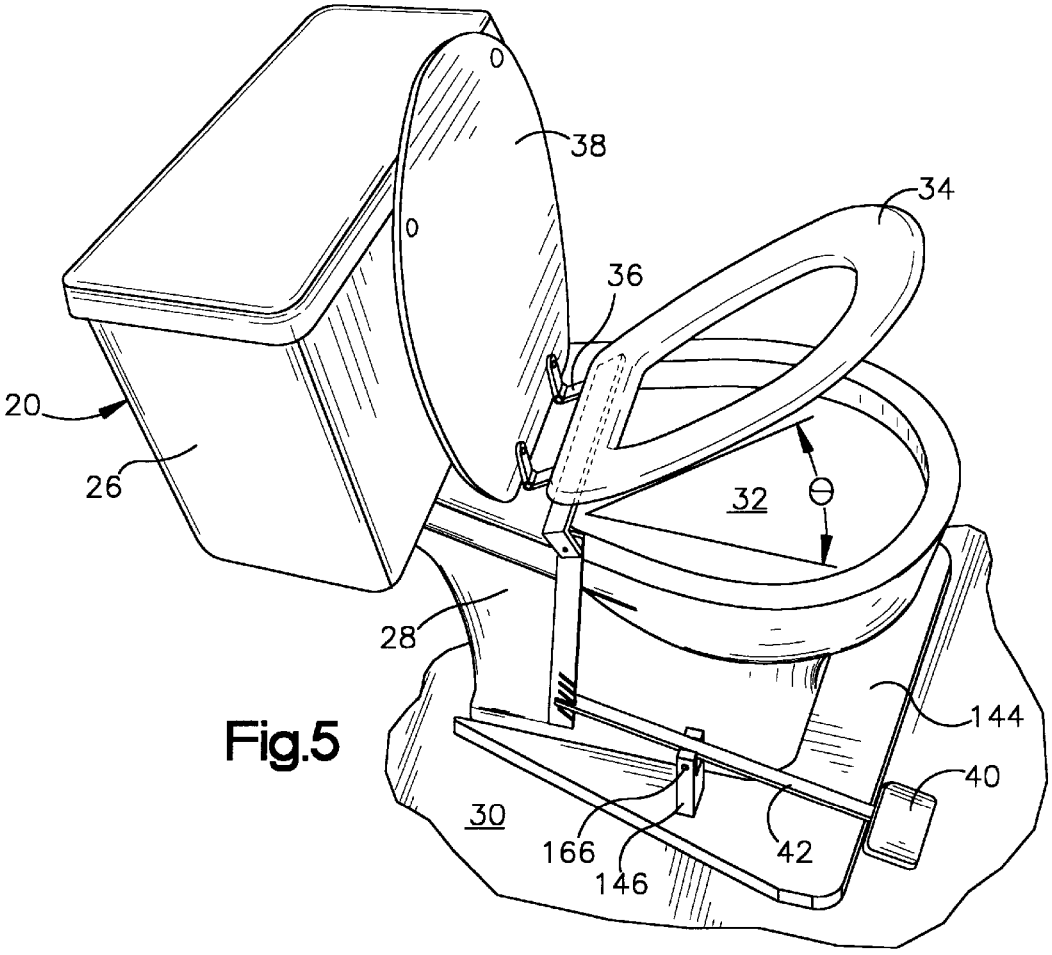
FIG. 5 is a perspective view of a toilet with a seat-lifting device incorporating the platform of FIG. 4, the device being shown in a state corresponding to the toilet seat being in the upper position.

Another modified version 244 of the platform is shown in FIG. 5. The platform 244 differs from the platforms 44 and 144 in that it only "hugs" one side bottom edge of the toilet base 28 and in that it surrounds the rear (rather than front) bottom edge of the base 28. To this end, the platform 244 is a flat plate component that has a roughly L-shape formed by a roughly triangular side section 248 and a roughly rectangular rear section 250. The platform's front corner (or end) 252 is rounded and its rear corner 254 is also rounded, although to a lesser degree than the front corner 252. The platform 244 includes a cut-out 256 which is shaped to correspond to the contour of one side bottom edge and the rear bottom edge of the toilet's base 28.

The platform 244 rests on the floor 30 adjacent the toilet's base 28 so that its side section 248 is positioned adjacent one of the side bottom edges of the toilet's base 28 and its rear section 250 is positioned adjacent the base's rear bottom edge. If necessary or desired, an adjustable stop 259 may be provided to brace the platform 244 against a wall in back of the toilet 20 to prevent rearward slipping thereof. In any event, the platform 244 also allows installation on either the right hand or left hand side of the toilet 20, however, this reversibility is accomplished by inverting the platform 244. To this end, the openings 258 for the pivot stand 46 may be counterbored on both sides.

The illustrated pivot stand 46 is generally in the form of an L-shaped block having a bottom portion 60 and an upper portion 62 extending upwardly from a rear end thereof. The bottom portion 60 includes a pair of openings (not shown) positioned to align with the openings 58/158/258 in the platform 44/144/244. In this manner, suitable fasteners may be inserted upward through the openings 58/158/258 and into the pivot stand's openings to secure it to the platform 44/144/244. The upper portion 62 includes a central top slot 64 through which a portion of the lever assembly 42 (namely an arm 70, introduced below) extends and is pivotally connected by a pivot rod 66.

Figure 6:
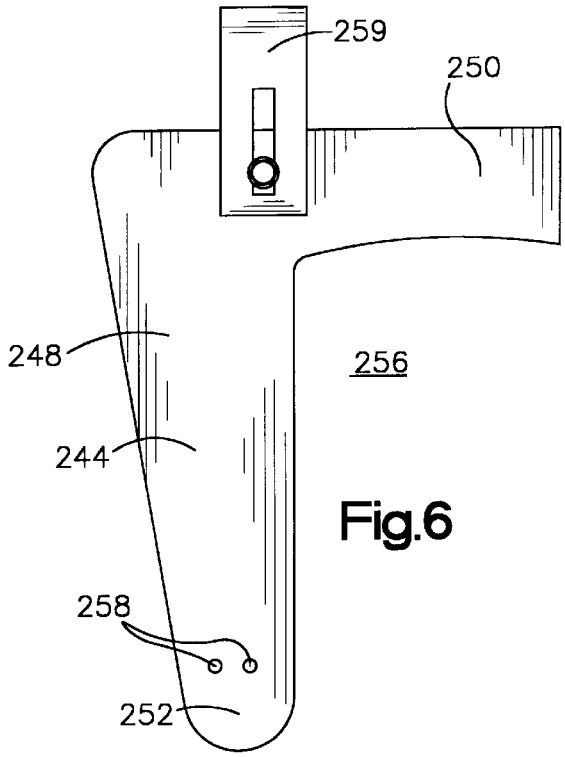
FIG. 6 is a plan view of another modified version of the platform.
Figure 7:
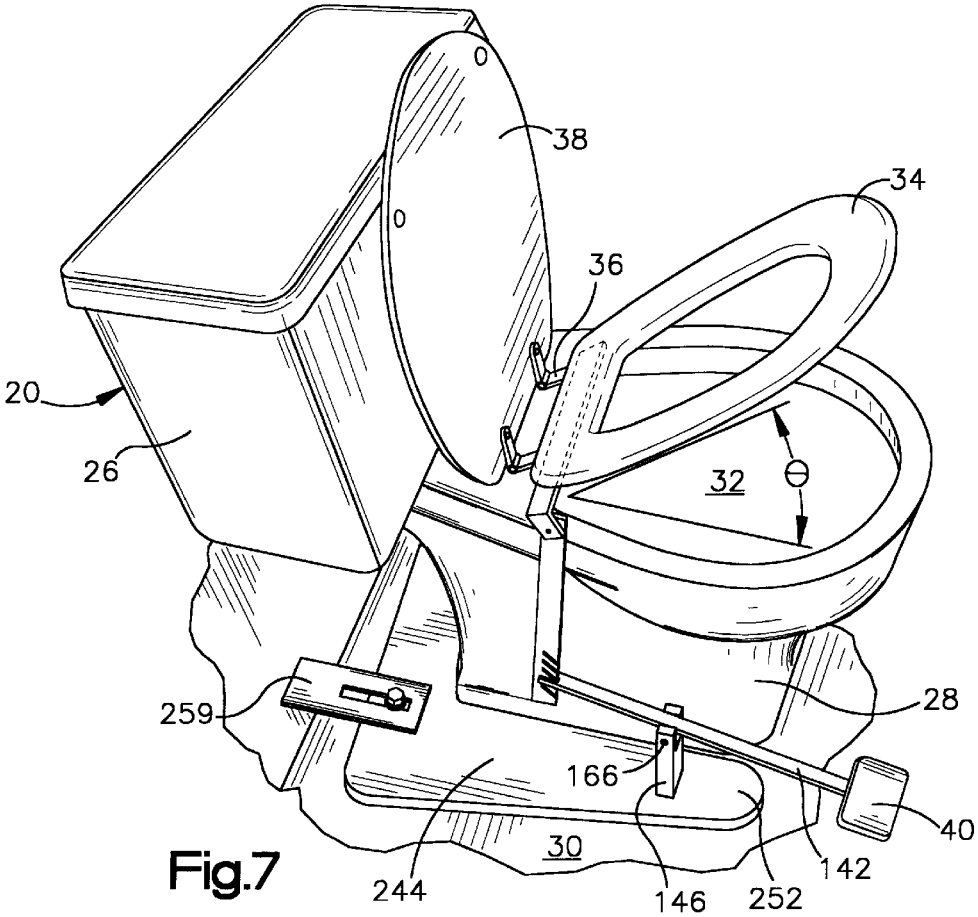
FIG. 7 is a perspective view of a toilet with a seat-lifting device incorporating the platform of FIG. 6, the device being shown in a state corresponding to the toilet seat being in the upper position.

The L-shaped pivot stand 46 may be used with the platform 44, the platform 144 and/or the platform 244. Alternatively, the modified pivot stand 146 shown in FIG. 6 may be used. The pivot stand 146 includes a bottom portion 160 and an upper portion 162. The bottom portion 160 essentially forms a rectangular pedestal for the upper portion 162 and, like the portion 60 of the pivot stand 46, includes a pair of openings (not shown) positioned to align with the openings 58/158/258 in the platform 44/144/244. The upper portion 162 is essentially identical to the portion 62 of the pivot stand 46. Specifically, it includes a central top slot 164 through which a portion of the lever assembly 42 extends and is pivotally connected by a pivot rod 166.

The pedal 40 is shaped to comfortably support a person's foot. In the illustrated embodiment, the pedal 40 is a solid structure having a flat rectangular upper surface that slopes slightly upward in the rearward direction. However, other non-solid, nonsloping, and other constructions of the pedal 40 are possible with, and contemplated by the present invention.

Figure 2:
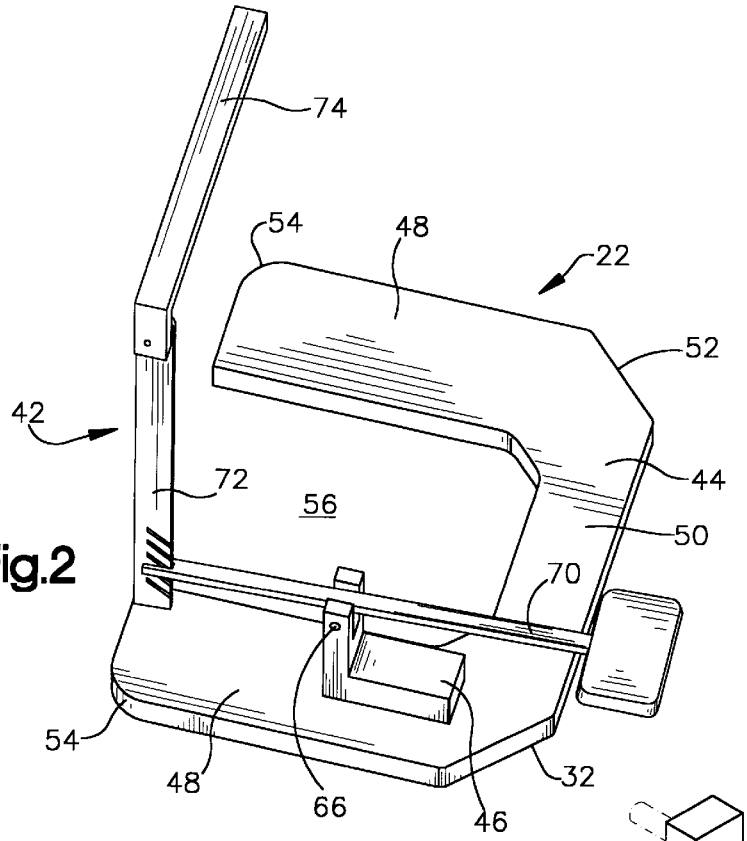
FIG. 2 is a perspective view of a platform and a pivot stand of the toilet seat-lifting device.
Figure 3:
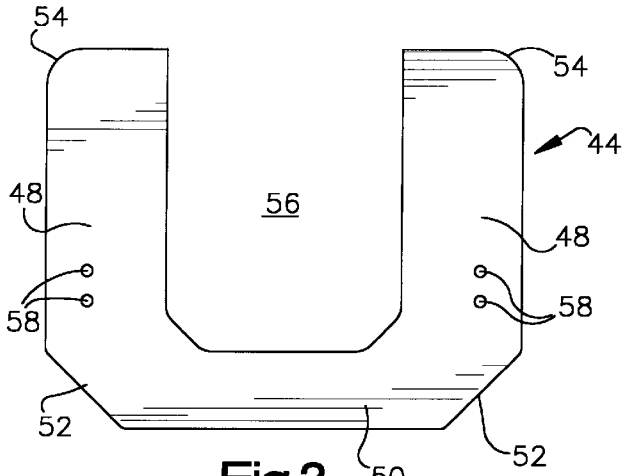
FIG. 3 is a plan view of the platform.
Figure 8:
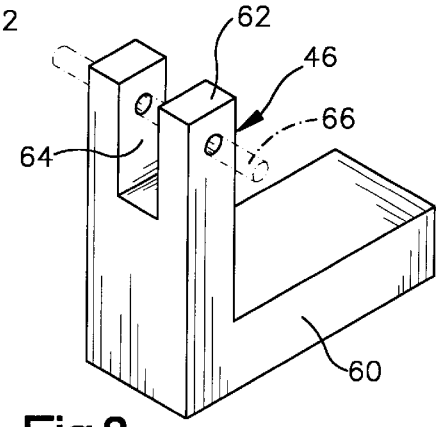
FIG. 8 is a perspective view of a pivot stand of the seat-lifting device.
Figure 9:
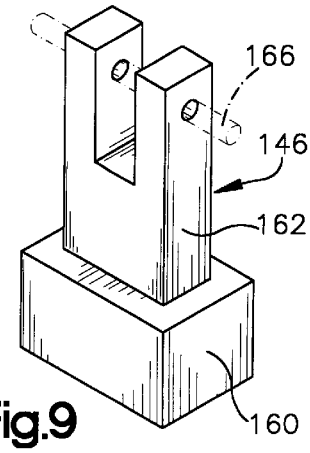
FIG. 9 is a perspective view of a modified version of the pivot stand.

Referring now back to FIG. 2, the lever assembly 42 includes a pedal-connecting arm 70, a lift arm 72, and a seat-connecting arm 74. These components are interconnected with each other, the pedal 40, and the pivot stand 46/146 so that when the pedal 40 is pushed downward, the toilet seat 34 is lifted to the upper position. Specifically, the rear end of the pedal-connecting arm 70 is pivoted upward thereby causing the lift arm 72 to move upward whereby the seat-connecting arm 74 lifts the toilet seat 34 to the upper position.

To this end, the front end of the arm 70 is fixedly secured to the pedal 40 by suitable fasteners, such as screws extending through a central region of the pedal 40 into the arm 70. The rear end of the arm 70 is slidingly received in the lift arm 72 (specifically in one of its grooves 88, introduced below). A central region of the arm 70 extends through the central top slot 64 of the pivot stand 46 and is pivotally connected thereto by the pivot rod 66. The upper end of the lift arm 72 is attached to one end of the seat-connecting arm 74 via the pivot rod 76. In the illustrated embodiment, this is the left-hand end of the seat-connecting arm 74, however, if the seat lifting device 22 was installed on the right-hand side of the toilet 20, the upper end of the lift arm 72 would be attached to the right-hand end of the seat-connecting arm 74. In either event, the seat-connecting arm 74 is attached to a rear portion of the toilet seat 34 adjacent the hinge members 36.

The pedal-connecting arm 70 is shown in detail in FIG. 10. The arm 70 has a generally rectangular bar shape with two vertical openings 78 at its front end and a horizontal opening 80 through an intermediate (but not necessarily central) portion. The openings 78 are used for connection of the arm 70 to the pedal 40. The opening 80 is used for connection of the arm 70 to the pivot stand 46 via the pivot rod 66.

A vertically extending notch 82 is provided at the rear end of the pedal-connecting arm 70 for connection to the lift arm 72. The arm 70 also includes a pair of aligned horizontal openings 84 and another pair of aligned horizontal openings 86 through the opposite sides of the notch 80. The openings 84 accommodate the insertion of the arm-to-arm pivot rod 76 and the openings 86 accommodate a stop bolt to prevent the lift arm 72 from inadvertently escaping from the notch 82.

The lift arm 72 is shown in detail in FIG. 11. The arm 72 has a generally rectangular bar shape and its lower end includes a series of upwardly slanted grooves 88. When assembling the toilet seat-lifting device 22, one of the grooves 88 is chosen to receive the arm-to-arm pivot rod 76. In this manner, the toilet seat-lifting device 22 is adjustable to accommodate different height toilet bases and/or to lift the toilet seat 34 to the desired upper position. The upper end of the lift arm 72 includes an opening 90 for receiving an appropriate fastening member for attachment of the lift arm 72 to the seat-connecting arm 74.

A modified lift arm 172 is shown in FIG. 12 and a modified pedal-connecting arm 170 for use therewith is shown in FIG. 13. The lift arm 172 is a rod-like member having a threaded turned upper end 187 and a threaded turned lower end 188. In the pedal-connecting arm 170, a nut mechanism 189 is mounted on the pivot rod 176. The lifting device 22 can thereby be adjusted by screwing/unscrewing the end 188 relative to the nut 189. An appropriate fastening member is used for attachment of the lift arm 172 to the seat-connecting arm 74.

Figure 14:
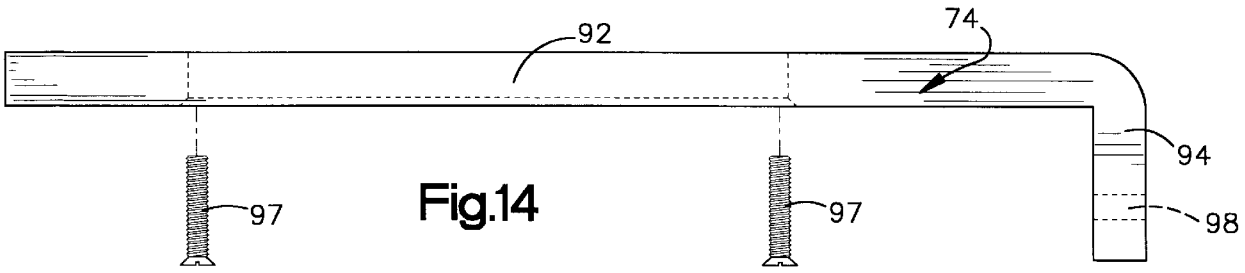
FIG. 14 is a front view of a seat-connecting arm of the toilet seat-lifting device.
Figure 15:
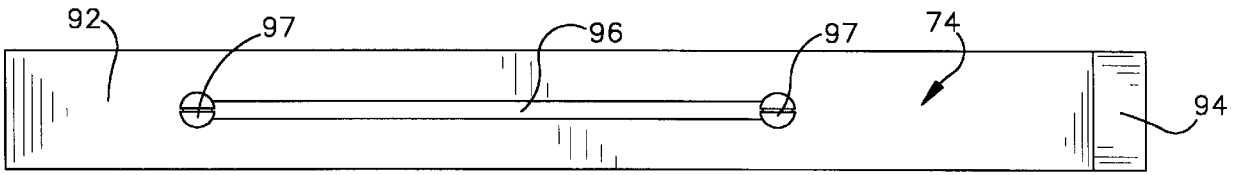
FIG. 15 is a top view of the seat-connecting arm.

The seat-connecting arm 74 is shown in detail in FIGS. 14 and 15. The arm 74 has an elongated L-shape with a top leg 92 and a shorter side leg 94 extending downward from one end thereof. A slot 96 in the top leg 92 adjustably accepts fastening members 97 which coordinate with hinge openings in the toilet seat 34 to thereby connect the arm 74 to the seat 34.

The side leg 94 of the arm 74 includes a vertical opening 98 which is used to attach the seat-connecting arm 74 to the lift arm 72/172. The seat-connecting arm 74 may be oriented to accommodate either a right-hand or left-hand installation of the toilet-seat lifting device 22. Specifically, if the toilet seat-lifting device 22 is installed on the left hand side of the toilet 20 (as shown in FIGS. 1A and 1B), the arm 74 is oriented so that the leg 94 is on the left-hand side of the seat 34. If the device 22 is installed on the right hand side of the toilet 20, the arm 74 is oriented so that the leg 94 is on the right-hand side of the seat 34. If the modified lift arm 172 is used, the seat-connecting arm 74 would include an opening to receive the upper threaded end 187 of the lift arm 172 and held in place with fastening member.

Figure 17:
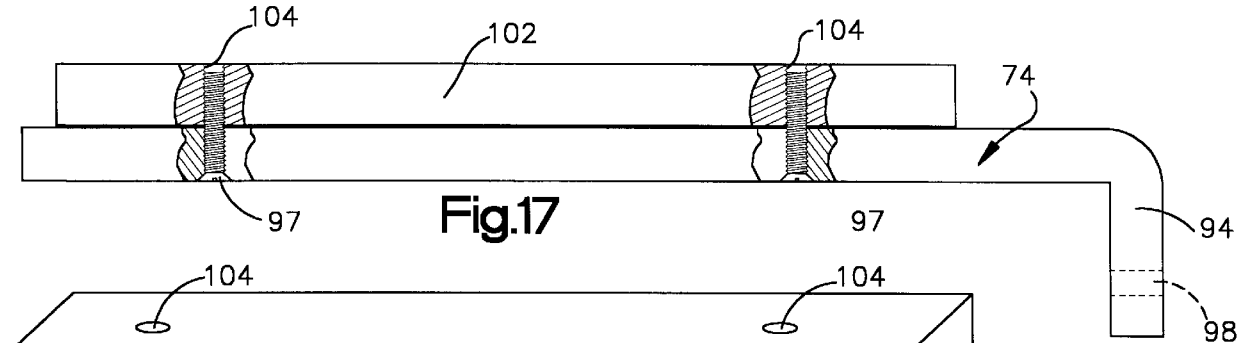
FIG. 17 is a side view of the interface and the seat-connecting arm.
Figure 16:
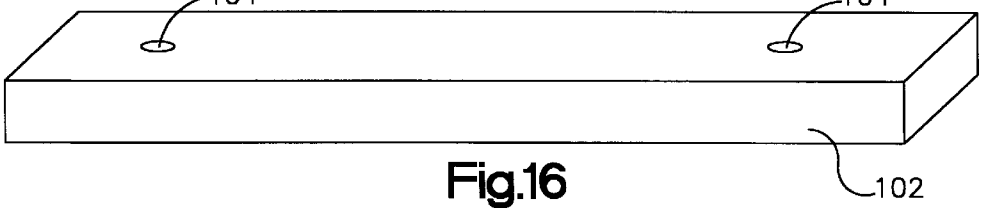
FIG. 16 is a perspective view of a seat interface of the toilet seat-lifting device.

If a toilet does not include hinge members 36 that accommodate attachment of the seat-connecting arm 74 via the openings 96, a seat-interface 102 such as is shown in FIGS. 16 and 17 may be provided. The interface 102 is essentially a rectangular member having openings 104 that may be aligned with the fastening members 97. The top surface of the interface 102 is attached to the toilet seat 34 by, for example, an adhesive. The seat-connecting arm 74 is attached to the interface 102 via the fastener members 97 that extend through the slot 96 and the openings 104.

One may now appreciate that the toilet seat-lifting device 22 does not require defacement of the bathroom floor/fixtures, can be installed on either side of the toilet, and/or accommodates different toilet designs. Also, the toilet seat-lifting device that can be economically fabricated. For example, the foot pedal 40, the platform 44/144/244, the pivot stand 46/146, and the interface 102 may be made from strong light-weight synthetic materials, the lever assembly 42 may be made from light-weight aluminum or steel, and the parts may be easily connected together using standard screws, nuts, bolts, washers, and adhesives.

Although the invention has been shown and described with respect to the preferred embodiment, it is apparent that certain alterations and modifications will occur to others skilled in the art upon a reading and understanding of this specification. The present invention includes all such alterations and modifications and is limited only by the following claims.

What is claimed is:

1. A toilet seat-lifting device for a toilet resting on a floor and having a base defining a bowl and a toilet seat pivotally attached to the base, said device comprising:

a lever assembly adapted to be coupled to the toilet seat to selectively move the seat between a lower position whereat it rests on top edges of the toilet bowl and an upper position whereat it is raised above the top edges of the toilet bowl;

a platform on which the lever assembly is mounted and which is adapted to rest on the floor, the platform adapted to at least partially surrounding the bottom edges of the toilet's base to provide a stable support for the lever assembly without having to directly attach the device to the toilet's base or floor; and a pedal attached to the lever assembly in such a manner that as the pedal is pushed downward, the toilet seat is lifted to the upper position, the pedal adapted to be positioned off-center relative to the front of the toilet bowl.

2. A toilet seat-lifting device as set forth in claim 1 wherein the platform comprises at least one side section and either a front section or a rear section that define a cut-out shaped to correspond to at least one bottom side edge of the toilet's base and either the bottom front edge or the bottom rear edge of the toilet's base.

3. A toilet seat-lifting device as set forth in claim 2 wherein the platform comprises two side sections and a front section and wherein the cut-out is shaped to correspond to the two bottom side edges of the toilet's base and the bottom front edge of the toilet's base.

4. A toilet seat-lifting device as set forth in claim 3 wherein the side sections each have a roughly rectangular shape.

5. A toilet seat-lifting device for a toilet resting on a floor and having a base defining a bowl and a toilet seat pivotally attached to the base, said device comprising:

a lever assembly adapted to be coupled to the toilet seat to selectively move the seat between a lower position whereat it rests on top edges of the toilet bowl and an upper position whereat it is raised above the top edges of the toilet bowl;

a platform on which the lever assembly is mounted and which is adapted to rest on the floor, the platform adapted to at least partially surrounding the bottom edges of the toilet's base to provide a stable support for the lever assembly without having to directly attach the device to the toilet's base or floor; and a pedal attached to the lever assembly in such a manner that as the pedal is pushed downward, the toilet seat is lifted to the upper position;

wherein the platform comprises two side sections and a front section that define a cut-out shaped to correspond to the two bottom side edges of the toilet's base and the bottom front edge of the toilet's base; and wherein the side sections each have a roughly triangular shape.

6. A toilet seat-lifting device for a toilet resting on a floor and having a base defining a bowl and a toilet seat pivotally attached to the base, said device comprising:

a lever assembly adapted to be coupled to the toilet seat to selectively move the seat between a lower position whereat it rests on top edges of the toilet bowl and an upper position whereat it is raised above the top edges of the toilet bowl;

a platform on which the lever assembly is mounted and which is adapted to rest on the floor, the platform adapted to at least partially surrounding the bottom edges of the toilet's base to provide a stable support for the lever assembly without having to directly attach the device to the toilet's base or floor; and a pedal attached to the lever assembly in such a manner that as the pedal is pushed downward, the toilet seat is lifted to the upper position;

wherein the platform comprises one side section and a rear section that define a cut-out shaped to correspond to one bottom side edge of the toilet's base and the bottom rear edge of the toilet's base.

7. A toilet seat-lifting device for a toilet resting on a floor and having a base defining a bowl and a toilet seat pivotally attached to the base, said device comprising a lever assembly adapted to be coupled to the toilet seat to selectively move the seat between a lower position whereat it rests on top edges of the toilet bowl and an upper position whereat it is raised above the top edges of the toilet bowl; and a platform on which the lever assembly is mounted and which is adapted to rest on the floor, the platform adapted to at least partially surrounding the bottom edges of the toilet's base to provide a stable support for the lever assembly without having to directly attach the device to the toilet's base or floor;

wherein the platform allows the mounting of the lever assembly on either a right-hand side or a left-hand side of the toilet.

8. A toilet seat-lifting device as set forth in claim 7 wherein the lever assembly comprises a lift arm operably attached to the toilet seat, a pedal arm attached to the pedal, and an adjustable connection between the lift arm and pedal-connecting arm.

9. A toilet seat-lifting device as set forth in claim 8 wherein the lever assembly further comprises a seat-connecting arm coupled to the toilet seat and wherein an upper end of the lift arm is coupled to the seat-connecting arm via a seat interface member.

10. A toilet seat-lifting device for a toilet having a base defining a bowl and a toilet seat pivotally attached to the base, said device comprising:

a lever assembly adapted to be coupled to the toilet seat;

a stand on which the lever assembly is pivotally supported;

a platform on which the stand is mounted on either a right-hand or left-hand side of the toilet; and a pedal coupled to the lever assembly so that when the pedal is pushed the toilet seat is moved from a lower position whereat it rests on top edges of a toilet bowl to an upper position whereat it is raised above the top edges of the toilet bowl;

wherein the seat-lifting device is adapted to allow mounting of the stand on either the right-hand or left-hand side of the toilet.

11. A toilet seat-lifting device as set forth in claim 10 wherein the stand is attached to the platform via a set of fastening members which extend upward through a set of openings in the platform and wherein the platform includes a set of openings located on both the right-hand side and the left-hand side of the toilet.

12. A toilet seat-lifting device as set forth in claim 10 wherein the stand is attached to the platform via a set of fastening members which extend upward through a set of openings in the platform and wherein the platform may be turned up-side-down to locate its set of openings located on both the right-hand side and the left-hand side of the toilet.

13. A toilet seat-lifting device as set forth in claim 10 wherein the lever assembly comprises a pedal-connecting arm, a lift arm, and a seat-connecting arm;

wherein the pedal-connecting arm is fixedly attached to the pedal and pivotally attached to the stand;

wherein the lift arm is adjustably attached to the pedal-connecting arm and fixedly attached to the seat-connecting arm;

wherein the seat-connecting arm may be fixedly attached to the toilet seat in two different orientations to accommodate either a left-hand side or right-hand side mounting of the device.

14. A toilet seat-lifting device comprising:

a lever assembly coupled to a toilet seat;

a pedal coupled to the lever assembly so that when the pedal is pushed the toilet seat is moved from a lower position whereat it rests on top edges of a toilet bowl to an upper position whereat it is raised above the top edges of the toilet bowl;

wherein the lever assembly comprises a lift arm operably attached to the toilet seat, a pedal-connecting arm attached to the pedal, and an adjustable connection between the lift arm and the pedal-connecting arm;

wherein the adjustable connection between the lift arm and the pedal-connecting arm comprises a set of grooves on one of the arms, one of which receives an end portion of the other one of the arms whereby the toilet seat lifting device is adjustable, by selecting the appropriate groove, to accommodate different height toilet bases and/or different desired upper positions; and wherein the lift arm comprises the set of grooves and the pedal-connecting arm includes a pivot rod which is received in one of the grooves.

* * * * *